US012434901B2

(12) United States Patent
Kadula et al.

(10) Patent No.: US 12,434,901 B2
(45) Date of Patent: Oct. 7, 2025

(54) DISPENSING HEAD FOR AN AEROSOL CONTAINER AND AN AEROSOL CONTAINER COMPRISING SUCH A HEAD

(71) Applicants: Marcin Kadula, Jaworzno (PL); Wiesław Kadula, Jaworzno (PL); Sebastian Korczyk, Jaworzno (PL); Stanisław Korczyk, Jaworzno (PL)

(72) Inventors: Marcin Kadula, Jaworzno (PL); Wiesław Kadula, Jaworzno (PL); Sebastian Korczyk, Jaworzno (PL); Stanisław Korczyk, Jaworzno (PL)

( * ) Notice: Subject to any disclaimer, the term of this patent is extended or adjusted under 35 U.S.C. 154(b) by 496 days.

(21) Appl. No.: 17/906,636

(22) PCT Filed: Mar. 22, 2021

(86) PCT No.: PCT/IB2021/052366
§ 371 (c)(1),
(2) Date: Sep. 19, 2022

(87) PCT Pub. No.: WO2021/191776
PCT Pub. Date: Sep. 30, 2021

(65) Prior Publication Data

US 2023/0142033 A1 May 11, 2023

(30) Foreign Application Priority Data

Mar. 22, 2020 (PL) ..... 433350

(51) Int. Cl.
*B65D 83/52* (2025.01)
*B65D 83/16* (2006.01)

(52) U.S. Cl.
CPC ..... *B65D 83/546* (2013.01); *B65D 83/164* (2025.01)

(58) Field of Classification Search
CPC ..... B65D 83/546; B65D 83/164
See application file for complete search history.

(56) References Cited

U.S. PATENT DOCUMENTS 3,138,301 A * 6/1964 Ward ..... B65D 83/53 222/335
4,953,759 A * 9/1990 Schmidt ..... B65D 83/52 222/402.2

(Continued)

FOREIGN PATENT DOCUMENTS

JP H0614081 U * 2/1994
KR 20070016722 A 2/2007

OTHER PUBLICATIONS

Machine translation of JP H0614081.*

(Continued)

*Primary Examiner* — Jeremy Carroll
(74) *Attorney, Agent, or Firm* — SERVILLA WHITNEY LLC

(57) ABSTRACT

The present invention relates to a dispensing head for dispensing a metered dose of product comprising a housing which comprises a mounting assembly for mounting to a flange of an aerosol container, wherein a valve body is arranged inside the housing, with a charging system extending from the lower end of the valve body for connecting with the aerosol container valve, wherein a stem block is movably mounted in the valve body, with a head stem extending from the upper end of the stem block and passing through an opening in the top wall of the housing, wherein at least one charging opening is arranged in the central region of the valve body, wherein a dispensing container is arranged around and hermetically connected to the valve body, the dispensing container provided with resilient means for compressing the dispensing container, wherein the dispensing container is arranged in a limiting container.

15 Claims, 6 Drawing Sheets

(56) References Cited

U.S. PATENT DOCUMENTS

Figure 1A:
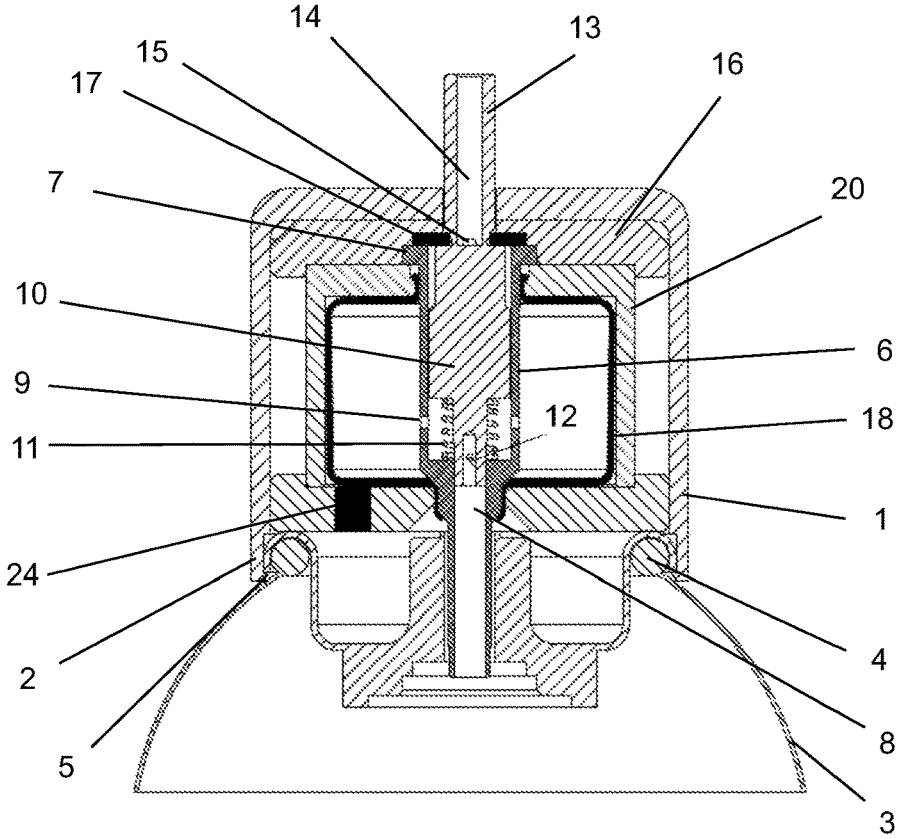

| | | | | |
|---|---|---|---|---|
| 6,273,304 | B1 | 8/2001 | Hoshino | |
| 10,591,337 | B1 * | 3/2020 | Neuhalfen | B05B 1/267 |
| 2009/0014679 | A1 * | 1/2009 | Hygema | B65D 83/42 251/368 |
| 2020/0062490 | A1 * | 2/2020 | Baker | B65D 83/40 |

OTHER PUBLICATIONS

Machine translation of JPH0614081U.
Machine translation of KR20070016722A.
PCT International Search Report in PCT/IB2021/052366 dated Jul. 2, 2021, 2 pages.

* cited by examiner

DISPENSING HEAD FOR AN AEROSOL CONTAINER AND AN AEROSOL CONTAINER COMPRISING SUCH A HEAD

CROSS-REFERENCE TO RELATED APPLICATIONS

This application is a National Phase entry of International Application No. PCT/IB2021/052366, filed Mar. 22, 2021, which claims priority to Polish Patent Application No. P.433350, filed Mar. 22, 2020, the disclosures of which are incorporated herein by reference in their entireties.

TECHNICAL FIELD

The present invention relates to a dispensing head for an aerosol container and an aerosol container comprising such a head. The objects of the invention are applied inter alia in pharmaceutical, food, cosmetic, and chemical industries, particularly for storing and dispensing agents at a predefined volume.

BACKGROUND

In recent years, a dynamic development of aerosol technologies, which allows the storing and administering of a wide range of products, has been observed. Aerosol containers have gained enormous popularity, as they offer efficiency, convenience and safety of use. Generally, an aerosol container is a disposable or reusable vessel, made of metal, glass, or plastic, containing pressurized, liquefied, or dissolved gas. Aerosol containers can also contain liquid, paste or powder, and are usually equipped with a dispensing device, enabling the application of the product in a form of solid or liquid particles suspended in gas, or in a form of foam, paste, or powder, or in a liquid or gaseous state. A classic aerosol container contains a sprayed agent (e.g. in liquid form) and a propellant, being a fluid or a gas under pressure. Triggering the aerosol valve causes the valve to be opened and the sprayed agent to be discharged by the pressurized propellant towards the outlet, usually ended with a nozzle, thus creating a finely dispersed stream.

Aerosol packages gained their popularity due to a number of advantages that they offer. Products stored in aerosol packages usually have long lifespan, mainly because of a hermetic sealing which prevents the contact between the stored product and the environment, especially pollutants and microorganisms. This advantage is particularly appreciated for storing pharmaceutical agents, where maintaining maximal purity is an essential factor. It should also be noted that, in time of a rising issue of global pollution, it is desirable to use packages that are mostly suitable for recycling, which the aerosol packages undoubtedly are, since they are usually manufactured from aluminum and plastic, almost entirely suitable for reprocessing.

In some branches of industry, aerosol systems are slow to gain appreciation and thus are not often the first choice for dispensing components. An especially demanding branch of industry is the pharmaceutical industry, in which medical substances must be dispensed under very stringent conditions. It is particularly important to provide the dispensation of a medical substance at a precisely metered dose, which frequently translates into the volume of this pharmaceutical substance. It is vital for controlling the particular amount of an active medical substance delivered to the organism. It is equally important to maintain highly repeatable metering of the doses of the dispensed substance, particularly in the case when the volume in the dispensing container decreases at every act of dispensing.

US2015239645A1 discloses a valve system for dosing a predetermined quantity of content, particularly in the form of foam. The valve system comprises a cap which is mounted on the valve and which houses a metering chamber. The volume of a dose is regulated by turning the cap and thus by changing the volume of the metering chamber. The system is based on a valve, which fills the metering chamber during the phase of pushing the stem, and which opens the discharge to the dispensing nozzle and discharges the contents outside the metering chamber during the phase of releasing the stem.

U.S. Pat. No. 5,031,802A discloses a container for dispensing a metered dose of the product. The container comprises a valve system fitted inside a bottleneck. The valve system comprises a metering chamber. The metering chamber is made of an elastic material in the form of a bellows. In order to discharge a metered dose of a product, a cap must be first removed. The removal of the cap causes the volume of the metering chamber to increase and creates a negative pressure. The negative pressure frees a ball which blocks a conduit connected with a plunger tube. In this manner, the conduit is opened and the metering chamber is filled with the product. Complete unscrewing of the cap breaks the fluid-tightness and causes the ball to drop.

Thus the user is provided with a metered volume of a product.

U.S. Pat. No. 3,301,444A discloses an aerosol valve allowing a predetermined measured volume of product to be dispensed. The valve comprises a rigid measuring chamber, which has its volume defined by the dose, and which is filled with the product when the valve is in closed position. The pressing of an actuator stem closes the metering chamber inlet aperture and opens the discharge outlet through the dispensing head. In such a case, the valve discharges the volume of a product contained in the rigid measuring chamber.

The technical problem of the present invention is to provide such a dispensing system used in aerosol containers which would allow an accurately metered volume of a product to be dispensed while maintaining highly repeatable doses until the container is completely emptied, this being achieved regardless of the surrounding conditions such as ambient temperature or the viscosity of the dispensed product. It is also desired that the dispensing system is of a relatively simple design, is a universal solution suitable for use in standard aerosol containers, and is exchangeable, wherein the introduction of the dispensing system on the aerosol container does not require the use of specialist tools.

SUMMARY

According to a first aspect of the present invention there is provided a dispensing head for dispensing a metered dose of product comprising a housing, characterized in that the housing comprises a mounting assembly for mounting to the flange of the aerosol container, wherein a valve body is arranged inside the housing, with a charging system extending from the lower end of the valve body for connecting with the aerosol container valve, wherein a stem block is movably mounted in the valve body, with a head stem extending from the upper end of the stem block and passing through an opening in the top wall of the housing, wherein at least one charging opening is arranged in the central region of the valve body, wherein a dispensing container is arranged around and hermetically connected to the valve body, the dispensing container being provided with resilient means for compressing the dispensing container, wherein the dispensing container is arranged in a limiting container.

Preferably, in the connection area of the stem block and the head stem, there is arranged at least one outlet opening communicated with an outlet channel of the head stem and closed in the normal position of the dispensing head by an inner seal.

In a preferred embodiment of the invention, the mounting assembly is provided with at least one circumferentially arranged mounting hook for a snap fit connection with the flange of the aerosol container.

In another preferred embodiment of the invention, the valve body has a valve spring arranged therein, which exerts pressure on the stem block in the direction of the head stem.

In a still another preferred embodiment of the invention, the charging system is in the form of a charging stem or a seat for the stem of the aerosol container valve.

Preferably, in the lower part of the stem block there is located a charging channel providing a fluid communication between the charging system and the inner space of the valve body.

Preferably, the assembly comprising the valve body, the stem block, the head stem, the dispensing container and the limiting container is vertically movable inside the housing.

Preferably, the dispensing head additionally comprises a triggering element projecting from the housing and an abutment member connected therewith for moving the assembly comprising the valve body, the stem block, the head stem, the dispensing container and the limiting container vertically inside the housing.

In a preferred embodiment of the invention, the dispensing head comprises a charging spring which exerts, after connecting to the aerosol container, pressure on the assembly comprising the valve body, the stem block, the head stem, the dispensing container and the limiting container in the direction away from the aerosol container.

In yet another preferred embodiment of the invention, the limiting container is hermetic, and the inner space of the limiting container is filled with gas.

In another preferred embodiment, the limiting container has a self-vulcanizing valve.

Preferably, the resilient means are a resilient piston or a resilient spongy material or a gas spring.

Preferably, the dispensing container provided with resilient means is a resilient dispensing container.

Preferably, the resilient dispensing container has an initial volume equal to zero, and the preliminary internal pressure from its elasticity has a positive value.

According to second aspect of the present invention there is provided a container for storing and dispensing a product of a predefined dose, comprising a dispensing head mounted to the flange, characterized in that the dispensing head is a dispensing head as defined in the first aspect of the present invention.

The dispensing head of the present invention, owing to the use of a resilient dispensing container arranged in a rigid limiting container, allows an accurately metered volume of a product to be dispensed while maintaining highly repeatable doses until the aerosol container is completely emptied, this being achieved regardless of the surrounding conditions such as ambient temperature or the viscosity of the dispensed product. The use of the triggering element and of the movable assembly comprising the valve body, the stem block, the head stem, the dispensing container and the limiting container in a vertical configuration inside the housing provides the possibility to charge the dispensing container in an on-demand operation. As a result, it is possible to meter a dose to be dispensed without the need to simultaneously discharge the product. Importantly, the dispensing head according to the invention is provided with mounting means which allow the dispensing head to be mounted to any standard aerosol container, this operation being relatively easy to perform and not requiring the use of any specialist tools or trained personnel. Moreover, the dispensing head has a simple construction, which does not influence the structure of a container comprising such a dispensing head.

DETAILED DESCRIPTION

The subject matter of the invention is not limited to the embodiments disclosed in the attached examples and can be applied to valves of any types and configurations, without diverting from the scope of the invention. All valve constructions, their positions and their relative arrangement (including vertical, horizontal, and diagonal configurations) known to a person skilled in the art will be suitable for application in the present invention, and the given embodiments are not intended to limit the invention to the disclosed structures and types of valve systems.

Figure 1B:
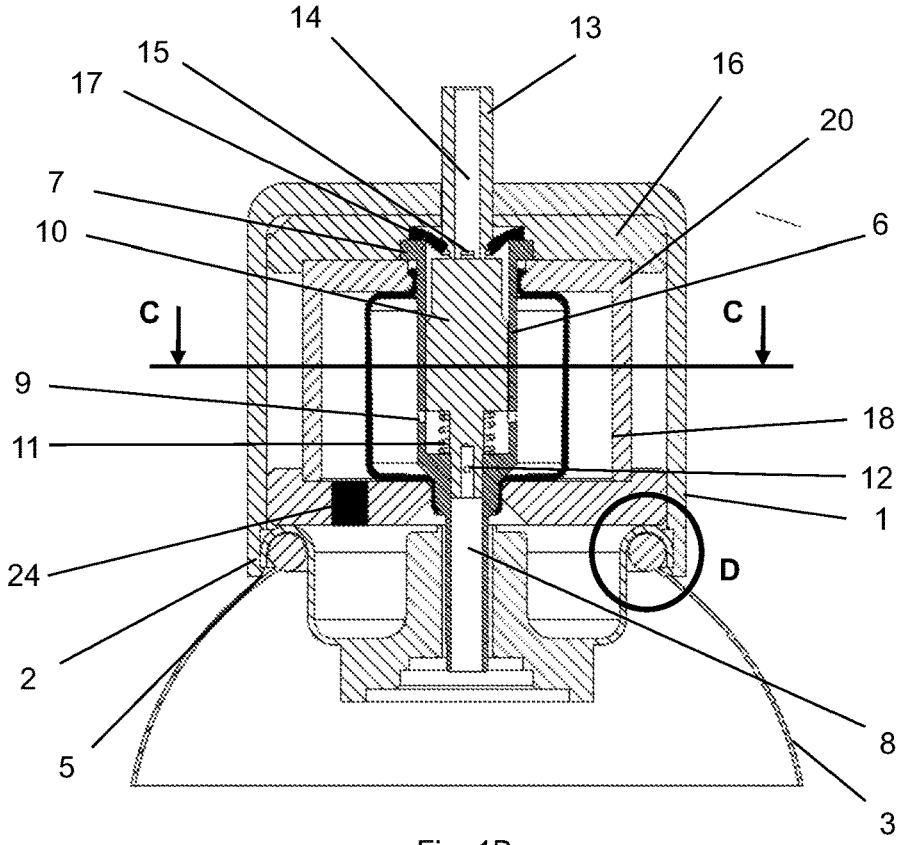
Figure 1C:
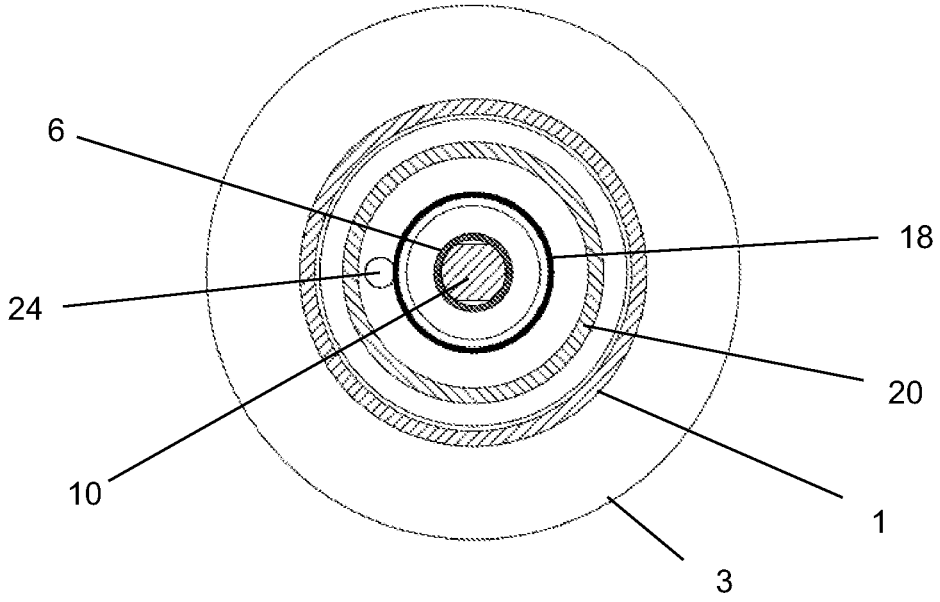
Figure 1D:
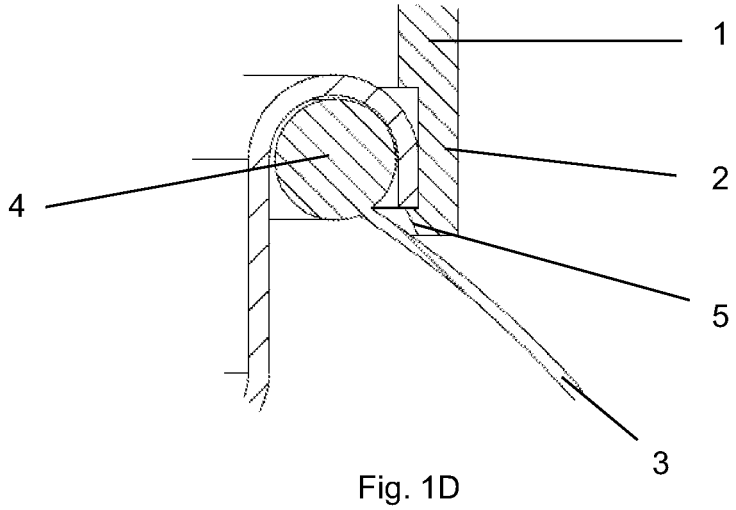
Figure 2A:
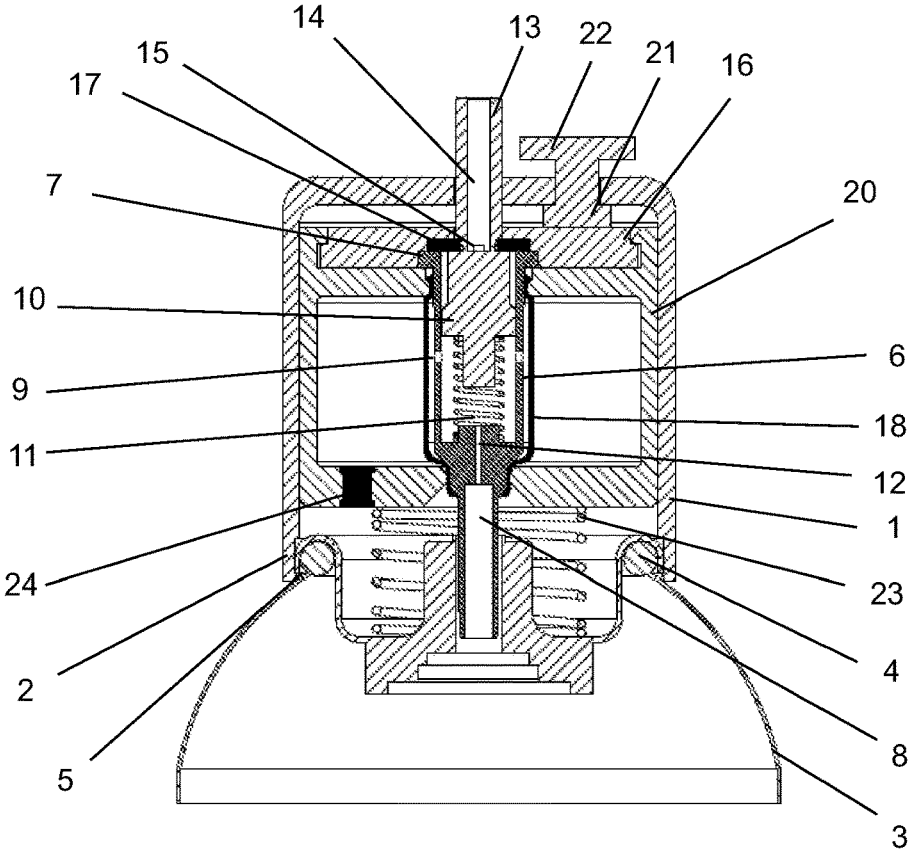
Figure 2B:
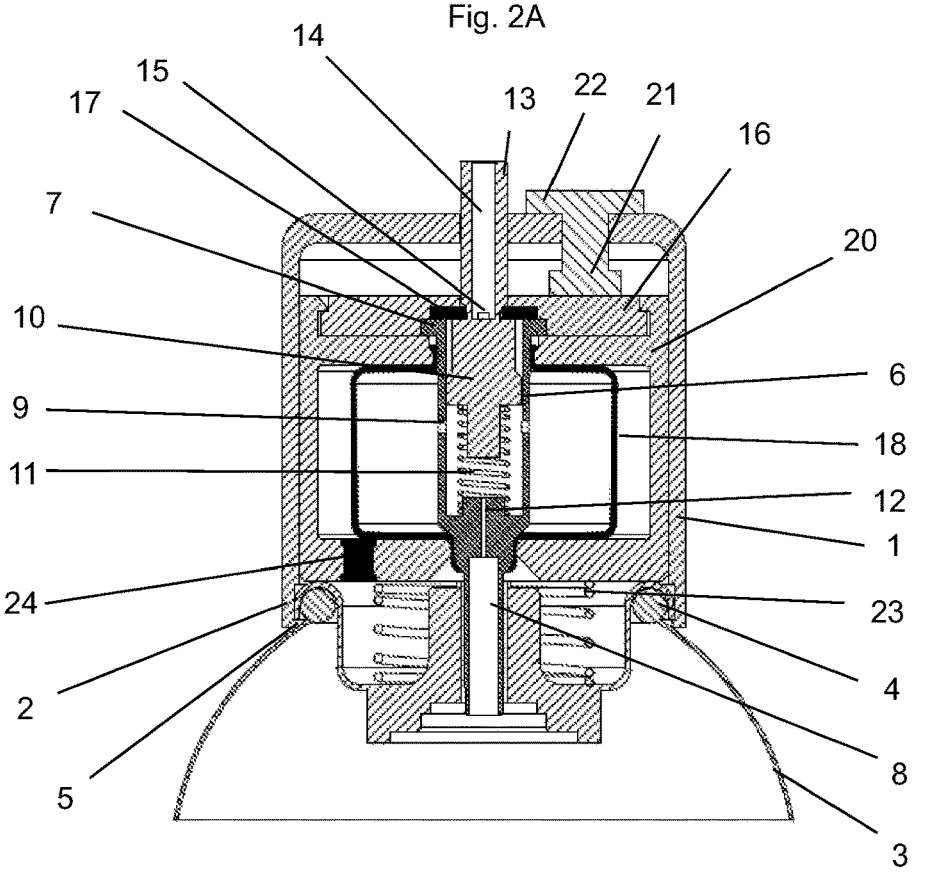
Figure 2C:
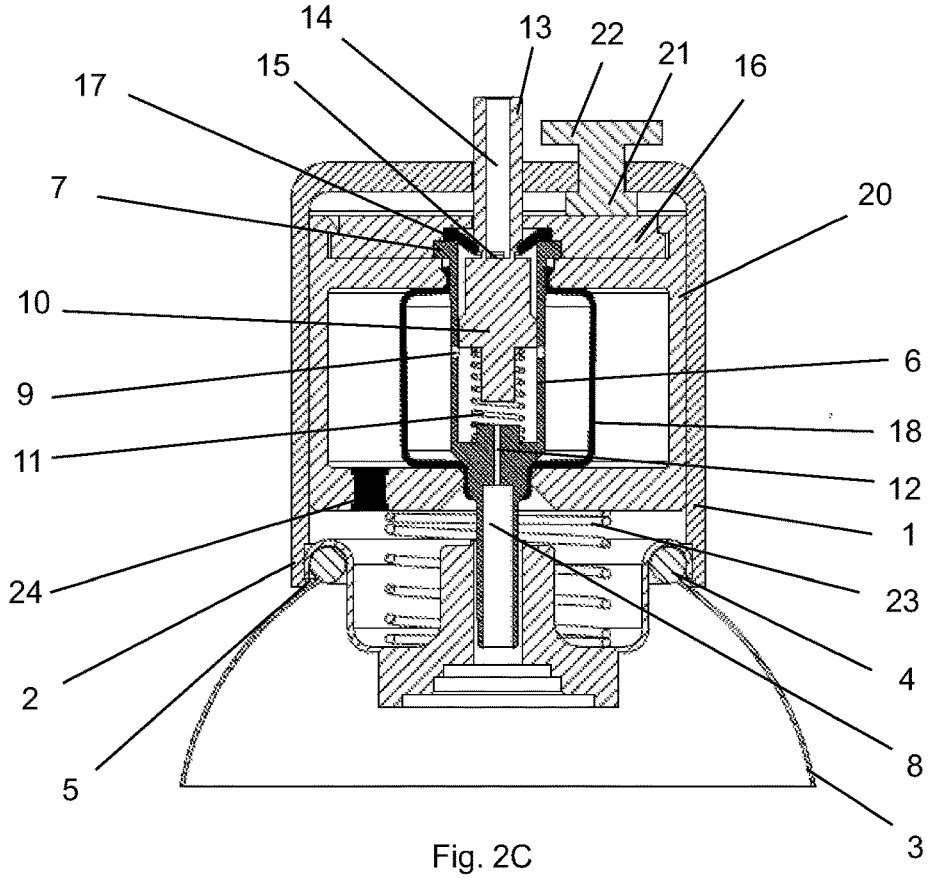
Figure 3A:
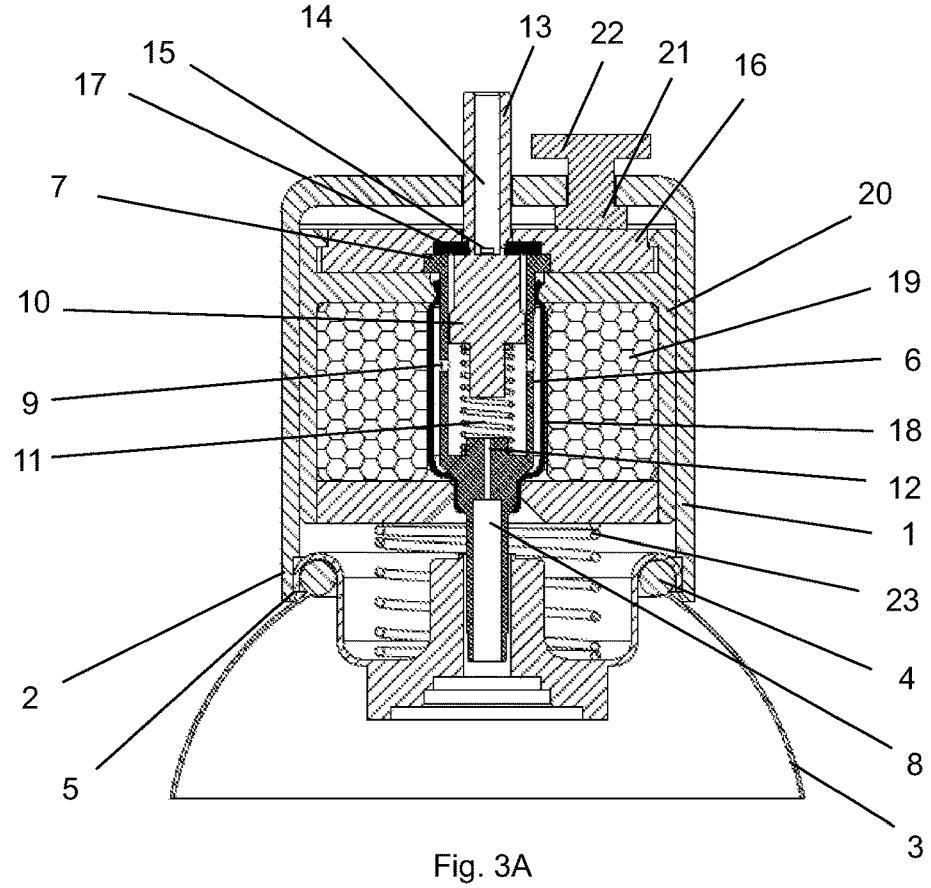
Figure 3B:
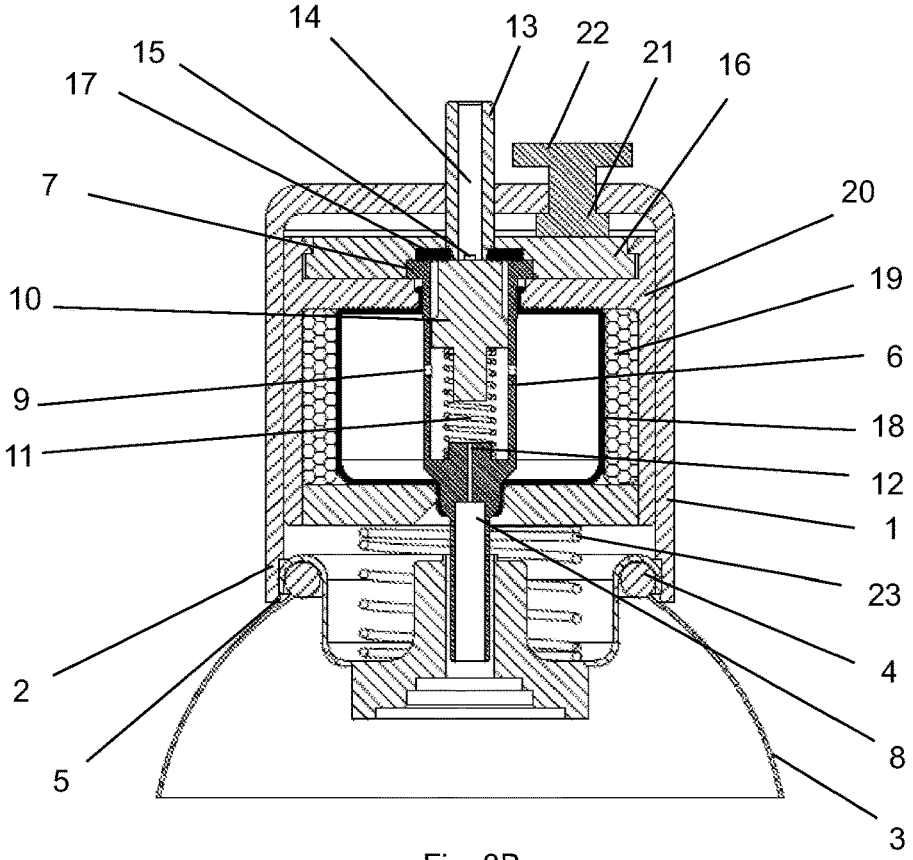
Figure 4A:
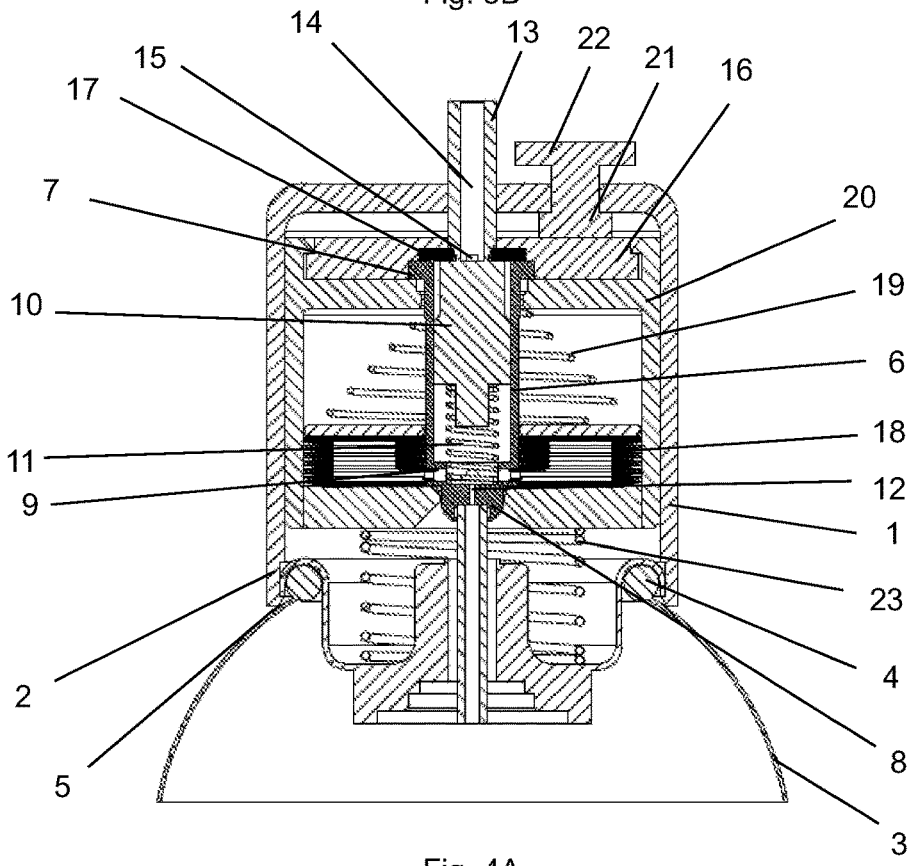
Figure 4B:
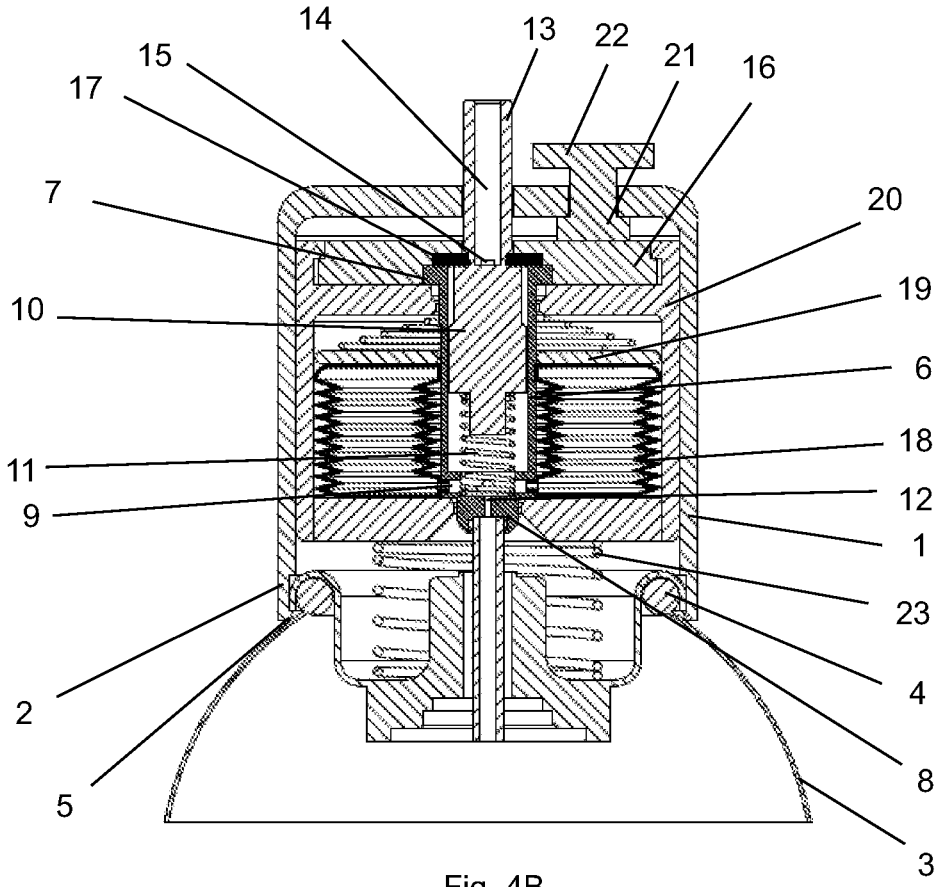

Embodiments of the invention are presented in the drawing, in which FIGS. 1A-1B show a partial longitudinal cross-section of the dispensing head according to the first embodiment of the invention, FIG. 1C is a cross-sectional view of the head of FIG. 1B along a plane indicated as C-C in FIG. 1B, FIG. 1D is an enlarged view of a detail indicated as D in FIG. 1B, FIGS. 2A-2C show a partial longitudinal cross-section of the dispensing head according to the second embodiment of the invention, FIGS. 3A-3B show a partial longitudinal cross-section of the dispensing head according to the third embodiment of the invention, and FIGS. 4A-4B show a partial longitudinal cross-section of the dispensing head according to the fourth embodiment of the invention.

Example 1

The first embodiment of the dispensing head for an aerosol container for dispensing a product of a predefined dose according to the present invention is illustrated in the partial longitudinal cross-sections in FIGS. 1A and 1B. FIG. 1C shows a cross-section made along a plane indicated as C-C in FIG. 1B, while FIG. 1D shows an enlarged view of a detail indicated as D in FIG. 1B.

The dispensing head is a separate structural member which is intended for mounting on the aerosol container 3. Generally, the dispensing head comprises a housing 1, which is the outer shell defining the top wall (distal with respect to the aerosol container 3) and the side wall extending substantially in the vertical direction. In this embodiment of the invention, the housing 1 in its longitudinal cross-section presents a structure in the shape of an inverted U. In the region of the lower end of the housing 1 side wall, there is located a mounting assembly 2, for detachable (or non-detachable) joining with the aerosol container 3. In practice, the dispensing head is joined with the aerosol container 3 by mounting the dispensing head on the flange 4 of the aerosol container 3, defined by the folded and pressed upper lid of the aerosol container 3. In this embodiment, the housing 1 side wall corresponds to a cylindrical shape, but this shape does not limit the present invention, and in alternative embodiments the housing 1 side wall may assume a different shape, such as a conical, prismatic or cuboidal shape.

As best illustrated in FIG. 1D, the lower end region of the housing 1 side wall is provided with the mounting assembly 2 extending along the circumference of the lower edge of the side wall. In this embodiment of the invention, the mounting assembly 2 takes the form of an inner annular circumferential recess adjacent to a mounting hook 5 on the edge side. The mounting hook 5 is a continuous structure extending along the entire circumference of the edge of the housing 1 side wall, but in alternative embodiments it can take a discreet form, extending circumferentially with a space provided between the consecutive mounting hooks 5. During the operation of mounting the dispensing head on the aerosol container 3, a force applied at a vertical direction towards the aerosol container 3 causes an elastic outward deformation of the lower end region of the housing 1 side wall, thus allowing the flange 4 of the aerosol container 3 to be introduced into the inner annular circumferential recess adjacent to the mounting hook 5 on the edge side in such a way that the mounting hook 5 is locked against the flange 4 of the aerosol container 3. As a result, the dispensing head can be mounted on the aerosol container 3 in a quick and relatively easy manner, without the need to use specialist tools.

There is a dispensing valve arranged inside the dispensing head housing 1. The dispensing valve comprises a valve body 6 extending substantially vertically inside the housing 1 of the dispensing head. The valve body 6 is a common component used in the art of aerosol valves. In this embodiment, the valve body 6 is a cylindrical structure defining a tubular inner opening. The outer and the inner diameters of the valve body 6 change along its length, with the upper edge of the valve body 6 comprising a retaining collar 7 having an increased outer diameter. Along the majority of its length, the valve body 6 extends towards the aerosol container 3 with constant inner and outer diameters. In its end region (proximal with respect to the aerosol container 3), the valve body 6 comprises a narrower segment having a smaller outer diameter with a transition region having a gentle transition of the outer diameter. The lower end of the valve body 6 is provided with a charging system 8 which ensures a fluid connection with the inner space of the aerosol container 3, on which the dispensing head of the invention is mounted. In this embodiment, the charging system 8 takes the form of a charging stem 8, with a channel extending inside it, wherein the charging stem 8 is introduced into the receiving valve seat in the aerosol container 3, on which the dispensing head is mounted. Therefore, this embodiment, in which the charging system 8 takes the form of a charging stem 8 extending from the housing 1 towards the aerosol container 3, is dedicated to aerosol containers provided with female dispensing valves comprising corresponding receiving seats. The type of the charging system 8, as well as its design, are not limited to this embodiment, and in alternative embodiments of the dispensing head it is possible to use a charging system 8 dedicated to male valves in aerosol containers 3.

On the other hand, the inner diameter of the valve body 6 shows a discrete change from the first diameter extending from the upper end of the valve body 6 towards the charging system 8 into the second diameter, smaller than the first diameter, wherein the discrete change of the inner diameter takes place in the vicinity of the charging system 8. Above the discrete change of the valve body 6 inner diameter and towards the retaining collar 7, there is a plurality of charging openings 9 arranged on the valve body 6 wall, which allow fluid communication between the tubular inner space of the valve body 6 and the space surrounding the valve body 6 on the outside. The number, shape and size of the charging openings 9 are not intended to limit to the scope of this invention.

Inside the valve body 6, there is arranged a stem block 10, is a component of the aerosol valve system known in the art. In more detail, the stem block 10 comprises a region having an outer diameter corresponding, along a part of the circumference, to the inner diameter of the valve body 6 for being precisely guided in the valve body 6, wherein along the remaining part of the circumference the stem block 10 has flattened regions (see cross-section C-C in FIG. 1C) for ensuring the flow of the product towards the head stem 13 and outside the dispensing head. The stem block 10 also has a region with its outer diameter matching the inner diameter of the charging system 8 channel together with a discrete change of the outer diameter corresponding to the discrete change of the inner diameter of the valve body 6. The discrete change of the stem block 10 outer diameter is provided in a region above the charging openings 9. Between the surfaces formed in the regions of discrete changes in the stem block 10 outer diameter and in the valve body 6 inner diameter, a valve spring 11 is arranged, located in this region in a state of a certain preload in such a manner that a constant force is exerted on the stem block 10 in the direction away from the aerosol container 3. In the lower region of the stem block 10, located in the vicinity of the end proximal to the aerosol container 3, there is formed a charging channel 12, which is above the region of discrete change in the valve body 6 inner diameter when the dispensing head is in a closed position, as shown in FIG. 1A. On the other hand, when the dispensing head is in an open position, shown in FIG. 1B, the charging channel 12 is located below the region of discrete change in the valve body 6 inner diameter and extends in the region of the smaller valve body 6 inner diameter, consequently resulting in the closing of the charging channel 12 and in preventing the fluid from flowing from the aerosol container 3 to the inner space of the valve body 6.

From the stem block 10 of the valve, on the side distal with respect to the aerosol container 3, there is a head stem 13 with an outlet channel 14 extending inside thereof. The head stem 13 passes through an opening in the housing 1 outer wall and extends outside the dispensing head. In the connection region of the head stem 13 and of the stem block 10, there are located outlet openings 15 which fluidly connect the outlet channel 14 with the inner space of the valve body 6 (in the open position shown in FIG. 1B).

Between the valve body 6 and the inner surface of the outer wall of the housing 1 of the dispensing head, there is arranged a fitting member 16, surrounding the retaining collar 7 of the valve body 6 and defining a seat for the inner seal 17 located in the region where the outlet openings 15 are located in such a manner that when the dispensing head valve is in the closed position (shown in FIG. 1A), the inner seal 17 closes the outlet openings 15, preventing the fluid from flowing to the outlet channel 14. In this embodiment, the inner seal 17 is realized in the form of a standard flat gasket.

In its central region (from the region in the vicinity of the retaining collar 7 to the region of a gentle change in the valve body 6 outer diameter), the valve body 6 is surrounded by a dispensing container 18 provided with resilient means, wherein the material of the dispensing container 18 is expandable to some an extent. In this embodiment of the invention, the dispensing container 18 together with the resilient means was embodied as a resilient material which ensures that the dispensing container 18 is continuously compressed. A material suitable for the construction of the dispensing container 18, which would provide a bulk modulus of the dispensing container 18 for the purpose of accumulating energy from the pressure of the product introduced into the dispensing container 18, can be latex rubber or silicone rubber, in particular rubber approved for contact with food or pharmaceutical products. In a situation when no pressurized agent is being delivered to the resilient dispensing container 18, the dispensing container 18 is completely empty.

The dispensing container 18 forms a hermetic inner space, which receives fluid from the aerosol container 3, on which the dispensing head of the invention is mounted. The dispensing container 18 is surrounded by a limiting container 20, which is a rigid container (although it is not intended to limit the scope of this invention, and in some embodiments of this invention the limiting container 20 may be flexible, but not capable of stretching). In this embodiment, the limiting container 20 has a cylindrical shape with a top wall which supports the retaining collar 7 of the valve body 6 and which is adjacent to the fitting member 16. The opening in the top wall of the limiting container 20 surrounds the valve body 6 and also fastens the upper part of the dispensing container 18, providing it with a fluid seal. The bottom wall of the limiting container 20 has an outer diameter substantially corresponding to the inner diameter of the dispensing head housing 1, and a central opening for accommodating the valve body 6 and for fastening the lower region of the dispensing container 18, providing it with a fluid seal. The bottom wall, the top wall and the side wall of the limiting container 20 define an inner volume of the limiting container 20 (with allowance for the space occupied by all of the components located inside), which corresponds to the volume of the dose dispensed from the dispensing head. In this embodiment, in the bottom wall there is arranged a self-vulcanizing valve 24, which is used for pre-gassing the limiting container 20, thus providing resilient means 19 which exert pressure on the dispensing container 18 (in the case when the dispensing container 18 is formed of a material which does not have an adequate resiliency). The pre-gassing pressure of the limiting container 20 is defined in such a manner that after the dispensing container 18 is filled with the product, the pressure inside the limiting container 20 is lower than the pre-gassing pressure in the aerosol container 3. As a result, the aerosol container 3 can be completely emptied.

The operating principle of the dispensing head according to this embodiment of the invention is as follows. In the first step, the dispensing head is mounted on the aerosol container 3. For this purpose, the dispensing head is pushed towards the aerosol container 3, and the charging stem 8 is introduced into the receiving seat of the aerosol container 3. The mounting assembly 2 in the form of the mounting hook 5 is deformed outwards, allowing the flange 4 of the aerosol container 3 to be introduced into the mounting assembly 2 and the mounting hook 5 to snap fit thereon. The mounting of the dispensing head on the aerosol container 3 causes the charging stem 8 to exert a pressure on the valve in the aerosol container 3, and as a result opens the valve permanently. After the dispensing head is mounted on the aerosol container 3, the bottom wall of the limiting container 20 rests on the flange 4 of the aerosol container 3. In this condition, shown in FIG. 1A, the head stem 13 is in the rest position, in which the inner seal 17 closes the outlet openings 15 and thus prevents the product from escaping outside the dispensing head. On the other hand, the charging channel 12 is located above the region of discrete change in the valve body 6 inner diameter and thus remains open to the inner space of the valve body 6. As a result, the product flows from the aerosol container 3 through the charging stem 8, further through the charging channel 12 into the inner space of the valve body 6, and then through the charging openings 9 to the dispensing container 18, causing it to expand and increase its volume. The dispensing container 18 expands to the volume limited by the limiting container 20 and simultaneously takes the energy from the pressure of the product, expanding the gas present in (filling) it to the state of equilibrium (see FIG. 1A). In a situation when the limiting container 20 is pre-gassed for providing resilient means 19 in the inner space of the limiting container 20, and the dispensing container 18 is formed of a material which does not have a resilient character, the resilient means 19 in the form of a gas under an adequate pressure take the energy from the pressure of the product. After the dispensing container 18 is completely filled, a metered dose of the product is present in the dispensing head, ready to be dosed through the head stem 13.

The pressing of the head stem 13 towards the aerosol container 3 causes the inner seal 17 to deform and the outlet openings 15 to open, and as a result the product present in the dispensing container 18 can be discharged through the outlet channel 14 to the outside of the dispensing head. The energy absorbed by the resilient means 19 (or only by the material of the dispensing container 18) causes the product in the dispensing container 18 to be pushed through the open fluid path to the outside of the dispensing head. Simultaneously, the lowering of the position of the stem block 10 causes the charging channel 12 to be moved to the inside of the charging stem 8, causing the flow of the product from the aerosol container 3 to the dispensing head to stop. As a result, the pressing of the head stem 13 allows only the product contained in the dispensing container 18 to be discharged, and this amount corresponds to a predefined volume of a single dose.

Releasing pressure on the head stem 13 causes the head stem 13 and the stem block 10 to return to the rest position, in which the dispensing container 18 is refilled to the volume limited by the limiting container 20. The returning of the head stem 13 to the rest position (shown in FIG. 1A) is possible owing to the preloaded valve spring 11. After the dispensing container 18 is filled, the dispensing head is ready for the discharging of another dose of a predefined volume.

Example 2

The second embodiment of the dispensing head for an aerosol container for dispensing a product of a predefined dose according to the present invention is illustrated in the partial longitudinal cross-sections in FIGS. 2A-2C.

The dispensing head according to the second embodiment of the invention has a structure similar to the structure of the dispensing head shown in the first embodiment, and therefore similar components will not be described again for the clarity of this description of the invention.

Unlike in the first embodiment of the invention, the second embodiment of the dispensing head comprises the limiting container 20 and the fitting member 16, which are capable of vertically moving inside the dispensing head housing 1. Between the upper surface of the fitting member 16 and the inner surface of the top wall of the housing 1, there is arranged a abutment member 21 of a triggering element 22 projecting from the housing 1 through the top wall of the housing 1 and taking the form of a button.

Between the bottom wall of the limiting container 20 and the surface surrounding the head portion of the aerosol container 3 valve, there is arranged a charging spring 23, which is located in an initial compression in such a manner that it exerts a pressure on the bottom wall of the limiting container 20 in the direction away from the aerosol container 3. In the rest position, the triggering element 22 projects maximally from the top wall of the dispensing head housing 1, with the distance from the triggering element to the top wall of the dispensing head housing 1 substantially corresponding to the distance between the bottom wall of the limiting container 20 and the upper surface of the flange 4 of the aerosol container 3. Unlike the dispensing head described in the first embodiment of this invention, the dispensing head according to the second embodiment of the invention comprises the stem block 10, which extends towards the inner space of the valve body 6, and not towards the channel extending through the charging stem 8. As a result, the charging channel 12 extends axially through the valve body 6 (through its lower part, proximal with respect to the aerosol container 3), and is not directed radially to the outside of the stem block 10, where it was possible to stop the product flowing through it from the aerosol container 3.

The operating principle of the dispensing head according to this embodiment of the invention is as follows. In the first step, the dispensing head is mounted on the aerosol container 3. For this purpose, the dispensing head is pushed towards the aerosol container 3, and the charging stem 8 is introduced into the receiving seat of the aerosol container 3. The mounting assembly 2 in the form of the mounting hook 5 is deformed outwards, allowing the flange 4 of the aerosol container 3 to be introduced into the mounting assembly 2 and the mounting hook 5 to snap fit thereon. The mounting of the dispensing head on the aerosol container 3 does not cause the charging stem 8 to exert a pressure on the valve in the aerosol container 3, and the valve in the aerosol container 3 remains closed. In this condition, shown in FIG. 2A, the dispensing head stem 13 is in the rest position, in which the inner seal 17 closes the outlet openings 15 and thus prevents the product from escaping outside the dispensing head. The charging stem 8 is introduced into the receiving seat of the aerosol container 3 valve, but does not exert a pressure on the valve, and as a result the valve is kept in a closed position.

As depicted in FIG. 2B, the pressing of the triggering mechanism 22 results in the movement of the abutment member 21 towards the aerosol container 3 and in the pushing of both the fitting member 16, supported against the abutment member 21, and the adjacent limiting container 20. The limiting container 20 moves downward in the dispensing head housing 1, counteracting the force exerted by the charging spring 23, until it reaches a position in which the bottom wall of the limiting container 20 is supported against the flange 4 of the aerosol container 3. Simultaneously, the charging stem 8 moves deeper in the seat of the aerosol container 3 valve causing it to open and release the product stored in the aerosol container 3. The inner seal 17 continues to close the outlet openings 15, preventing the product from escaping outside the dispensing head. In this situation, the product flows from the aerosol container 3 through the charging stem 8, further through the charging channel 12 into the inner space of the valve body 6, and then through the charging openings 9 to the dispensing container 18, causing it to expand and increase its volume. The dispensing container 18 expands to the volume limited by the limiting container 20 and simultaneously takes the energy from the pressure of the product, expanding the gas present in (filling) it to the state of equilibrium.

After the dispensing container 18 is completely filled, the triggering element 22 is released and, owing to the force exerted by the charging spring 23, the limiting container 20 together with the valve body 6, the dispensing container 18, the fitting member 16 and other components is moved upwards (in the direction away from the aerosol container 3), returning to the rest position shown in FIG. 2A.

The pressing of the head stem 13 towards the aerosol container 3 causes the inner seal 17 to deform and the outlet openings 15 to open, and as a result the product present in the dispensing container 18 can be discharged through the outlet channel 14 to the outside of the dispensing head (see FIG. 2C). The energy absorbed by the resilient means 19 (or only by the material of the dispensing container 18) causes the product in the dispensing container 18 to be pushed through the open fluid path to the outside of the dispensing head. In this position, the charging stem 8 does not exert a pressure on the aerosol container 3 valve (it remains closed), and therefore the pressing of the head stem 13 allows only the product contained in the dispensing container 18 to be discharged, and this amount corresponds to a predefined volume of a single dose.

Releasing the pressure on the head stem 13 causes the head stem 13 and the stem block 10 to return to the rest position, in which the dispensing head is ready for the dispensing container 18 to be filled again.

Example 3

The third embodiment of the dispensing head for an aerosol container for dispensing a product of a predefined dose according to the present invention is illustrated in the partial longitudinal cross-sections in FIGS. 3A and 3B.

The dispensing head according to the third embodiment of the invention has a structure similar to the structure of the dispensing head described in the second embodiment, and therefore similar components will not be described again for the clarity of this description of the invention.

Unlike in the second embodiment of the invention, the third embodiment of the dispensing head comprises resilient means 19 exerting pressure on the dispensing container 18, which are neither an integrated structure of the resilient dispensing container 18, as was the case in example 1, nor air (or any other gas), as was the case in example 2, but are instead made in the form of a resilient spongy material. The spongy material, which in this embodiment forms the resilient means 19, may be an elastic medical silicone.

The operating principle of the dispensing head in which the resilient spongy material is used in place of compressed air is analogous, and therefore this description will not be repeated for the clarity of this disclosure.

Example 4

The fourth embodiment of the dispensing head for an aerosol container for dispensing a product of a predefined dose according to the present invention is illustrated in the partial longitudinal cross-sections in FIGS. 4A and 4B.

The dispensing head according to the fourth embodiment of the invention has a structure similar to the structure of the dispensing head described in the second and in the third embodiments, and therefore similar components will not be described again for the clarity of this description of the invention.

Unlike in the second and in the third embodiments of this invention, the fourth embodiment of the dispensing head comprises the charging system 8, which is in the form of a seat 8 (unlike the charging stem in the previous embodiments) receiving the stem of the aerosol container 3 valve. Therefore, this embodiment, in which the charging system 8 takes the form of the seat 8 receiving the stem of the aerosol container 3 valve, is dedicated to aerosol containers provided with male dispensing valves comprising corresponding releasing stems.

Moreover, the dispensing container 18, made of an elastic (non-resilient) material, is not mounted in the upper part through the outer surface of the valve body 6 and through the opening in the top wall of the limiting container 20, as is the case examples 1-3, but instead it is hermetically connected with the charging openings 9 provided in the valve body 6. In order to allow it to be more precisely emptied, the dispensing container 18 is made in the form of a harmony or a bellows.

In this embodiment, the resilient means 19 are made in the form of a resilient piston. The resilient piston is arranged in the limiting container 20 and has a piston part and a spring which is supported against the inner surface of the top wall of the limiting container 20. FIG. 4A shows the dispensing head, in which the dispensing container 18 is empty, and the resilient means 19 in the form of a resilient piston are in the fully expanded position, compressing entirely the dispensing container 18. In this embodiment, the dispensing container 18 may be made of an elastic material such as a material for a bag of the Bag-on-Valve systems.

After the procedure of filling the dispensing container 18 is started, the product delivered under pressure exerts a force on the resilient means 19 and overcomes their compressive force, "accumulating" the energy of the pressurized product. Thereby the dispensing container 18 expands to the volume limited by the volume of the limiting container 20 with allowance for the space occupied by the compressed resilient means 19 (see FIG. 4B). The operating principle of the dispensing head with the resilient piston is analogous, and therefore this description will not be repeated for the clarity of this disclosure.

LIST OF REFERENCE NUMERALS

1—housing of the dispensing head
2—mounting assembly
3—aerosol container
4—flange of the aerosol container
5—mounting hook
6—valve body
7—retaining collar
8—charging system
9—charging opening
10—stem block
11—valve spring
12—charging channel
13—head stem
14—outlet channel
15—outlet openings
16—fitting member
17—inner seal
18—dispensing container
19—resilient means
20—limiting container
21—abutment member
22—triggering element
23—charging spring
24—self-vulcanizing valve

What is claimed is:

1. A dispensing head for dispensing a metered dose of product, comprising a housing, wherein the housing comprises a mounting assembly for mounting to a flange of an aerosol container, wherein a valve body is arranged inside the housing, with a charging system extending from the lower end of the valve body for connecting with the aerosol container valve, wherein a stem block is movably mounted in the valve body, with a head stem extending from the upper end of the stem block and passing through an opening in the top wall of the housing, wherein at least one charging opening is arranged in the central region of the valve body, wherein a dispensing container is arranged around and hermetically connected to the valve body, the dispensing container being provided with resilient means for compressing the dispensing container, wherein the dispensing container is arranged in a limiting container, wherein the dispensing container provided with the resilient means is a resilient dispensing container, or the resilient means are a resilient piston or a resilient spongy material or a gas spring.

2. The dispensing head according to claim 1, wherein in the connection area of the stem block and the head stem, there is arranged at least one outlet opening communicated with an outlet channel of the head stem and closed in the normal position of the dispensing head by an inner seal.

3. The dispensing head according to claim 2, wherein the inner seal closes the at least one outlet opening preventing a fluid from flowing from the aerosol container to the outlet channel.

4. The dispensing head according to claim 1, wherein the mounting assembly is provided with at least one circumferentially arranged mounting hook for a snap fit connection with the flange of the aerosol container.

5. The dispensing head according to claim 1, wherein the valve body has a valve spring arranged therein, which exerts pressure on the stem block in the direction of the head stem.

6. The dispensing head according to claim 1, wherein the charging system is in the form of a charging stem or a seat for the stem of the valve of the aerosol container.

7. The dispensing head according to claim 1, wherein in the lower part of the stem block there is located a charging channel providing a fluid communication between the charging system and the inner space of the valve body.

8. The dispensing head according to claim 7, wherein when the dispensing head is in an open position, the charging channel is closed and prevents a fluid from flowing from the aerosol container to the inner space of the valve body.

9. The dispensing head according to claim 1, wherein the assembly comprising the valve body, the stem block, the head stem, the dispensing container and the limiting container is vertically movable inside the housing.

10. The dispensing head according to claim 9, further comprising a triggering element projecting from the housing and an abutment member connected therewith for moving the assembly comprising the valve body, the stem block, the head stem, the dispensing container and the limiting container vertically inside the housing.

11. The dispensing head according to claim 10, further comprising a charging spring which exerts, after connecting to the aerosol container, pressure on the assembly comprising the valve body, the stem block, the head stem, the dispensing container and the limiting container in the direction away from the aerosol container.

12. The dispensing head according to claim 1, wherein the limiting container is hermetic, and the inner space of the limiting container is filled with gas.

13. The dispensing head according to claim 12, wherein the limiting container has a self-vulcanizing valve.

14. The dispensing head according to claim 1, wherein the resilient dispensing container has an initial volume equal to zero, and the preliminary internal pressure from its elasticity has a positive value.

15. An aerosol container for storing and dispensing a product of a predefined dose, comprising a dispensing head mounted to the flange, wherein the dispensing head is the dispensing head according to claim 1.

* * * * *